United States Patent [19]

Bolin

[11] 4,111,511

[45] Sep. 5, 1978

[54] HIGH CURRENT CONTACT ASSEMBLY

[75] Inventor: Philip C. Bolin, Westborough, Mass.

[73] Assignee: Westinghouse Electric Corp., Pittsburgh, Pa.

[21] Appl. No.: 836,171

[22] Filed: Sep. 23, 1977

[51] Int. Cl.[2] ..... H01R 13/62

[52] U.S. Cl. ..... 339/64 R; 339/255 R

[58] Field of Search ..... 339/64, 255 R, 255 P, 339/262

[56] References Cited

U.S. PATENT DOCUMENTS

| | | | |
|---|---|---|---|
| 3,594,697 | 7/1971 | Azbell | 339/255 P |
| 3,963,298 | 6/1976 | Seiler | 339/95 R |
| 3,982,806 | 9/1976 | Wilson et al. | 339/64 R |

FOREIGN PATENT DOCUMENTS

| | | | |
|---|---|---|---|
| 506,922 | 5/1976 | U.S.S.R. | 339/255 R |

*Primary Examiner*—Joseph H. McGlynn
*Attorney, Agent, or Firm*—M. S. Yatsko

[57] ABSTRACT

A contact assembly for electrically connecting two electrical conductors wherein a plug member is secured to one conductor, and a hollow socket member is secured to the other conductor, with the plug being received by the socket member. The socket member has an annular recess therein, and a plurality of contact fingers are disposed within the recess. A holder is also disposed within the recess, and the holder has an axial projection extending therefrom adjacent the contact fingers radially outwardly therefrom. The holder projection and the holder are spaced apart from the socket member to form an annular space therebetween. Resilient biasing means are disposed between the contact fingers and the holder and acts upon the contact fingers, and loading means are utilized to produce a force upon the contact fingers. The force has a component in the radial direction and a larger component in the axial direction, producing respectively contact pressure between the fingers and the plug member and the fingers and the socket member.

7 Claims, 2 Drawing Figures

HIGH CURRENT CONTACT ASSEMBLY

CROSS-REFERENCE TO RELATED APPLICATION

Reference is made to an application for Letters Patent entitled "High Current Contact" by J. R. Meyer, Ser. No. 801,122 filed May 27, 1977, and assigned to the same assignee as the present invention.

BACKGROUND OF THE INVENTION

This invention relates generally to electrical apparatus, and more particularly to high-current sliding contact assemblies.

Many devices used in the transmission and distribution of electrical energy require sliding contact current transfer members. Such devices include gas-insulated or air-type disconnect switches, grounding switches, high-current bus switches, and air- or gas-insulated transmission line joints. Each of these devices includes two electrical conductors which are relatively movable with respect to each other. In the case of the switches, the two conductors are relatively movable with respect to each other between an open position where the members are physically separated and a closed position wherein the members are in mechanical engagement allowing electrical energy to flow therebetween. In the case of air- or gas-insulated transmission line joints, the two members are movable with respect to one another to allow for thermal expansion of the conductors due to the heat generated in the transmission of the electrical energy.

The problem to be solved in all of these devices is that of reducing electrical resistance at the point of mechanical engagement. This resistance produces a joule-heating effect as current passes therethrough, thereby limiting the maximum amount of current which can be safely transferred. Methods for reducing this resistance include providing a large number of separate points of engagement between the separable members and providing contact pressure urging the two members together. While increasing the contact pressure and increasing the number of points of engagement between the separable members reduces the resistance, it also means that the forces required for moving the conductors relative to one another must be considerable, thereby either increasing the cost of such movement-imparting mechanism or incorporating other means for compensating for thermal expansion.

Prior art devices have included a plurality of spring-loaded contact fingers to provide a multiplicity of contact points upon each of which is exerted a spring force in a direction perpendicular to the direction of relative movement between the electrical conductors.

One problem with the prior art devices is the need to provide for misalignment of the two electrical conductors. This is especially critical for air- or gas-insulated transmission line joints, where each section of the line may be up to 60 feet in length and the maneuverability of such sections to provide for precise alignment is minimal.

SUMMARY OF THE INVENTION

In accordance with this invention, a more desirable high-current contact assembly is provided for electrically connecting first and second electrical conductors which comprises a cylindrical plug member physically secured to a first conductor, and a cylindrical, hollow socket member fixedly secured to the second conductor. The socket member receives the plug member therein, and the socket member has an annular recess thereabout. A plurality of contact fingers are disposed within the recess and are seated against a radial surface of the socket member. An annular holder is disposed within the recess axially spaced from the contact fingers, and the holder has an annular axial projection therefrom extending axially adjacent the contact fingers radially outwardly therefrom. The holder projection is spaced apart from the socket member, and forms therewith an annular space therebetween. Resilient biasing means are disposed between the contact fingers and the holder, and acts upon each of the contact fingers. Means are connected to the housing, and physically contact the holder, for loading the biasing means so as to produce a force upon the contact fingers. The force has radial and axial components, with the radial component producing contact pressure between the fingers and the plug member, and the axial component producing contact pressure between the fingers and the socket member.

DESCRIPTION OF THE DRAWING

Reference is now made to the description of the preferred embodiment illustrated in the accompanying drawings, in which.

DESCRIPTION OF THE PREFERRED EMBODIMENT

Figure 1:
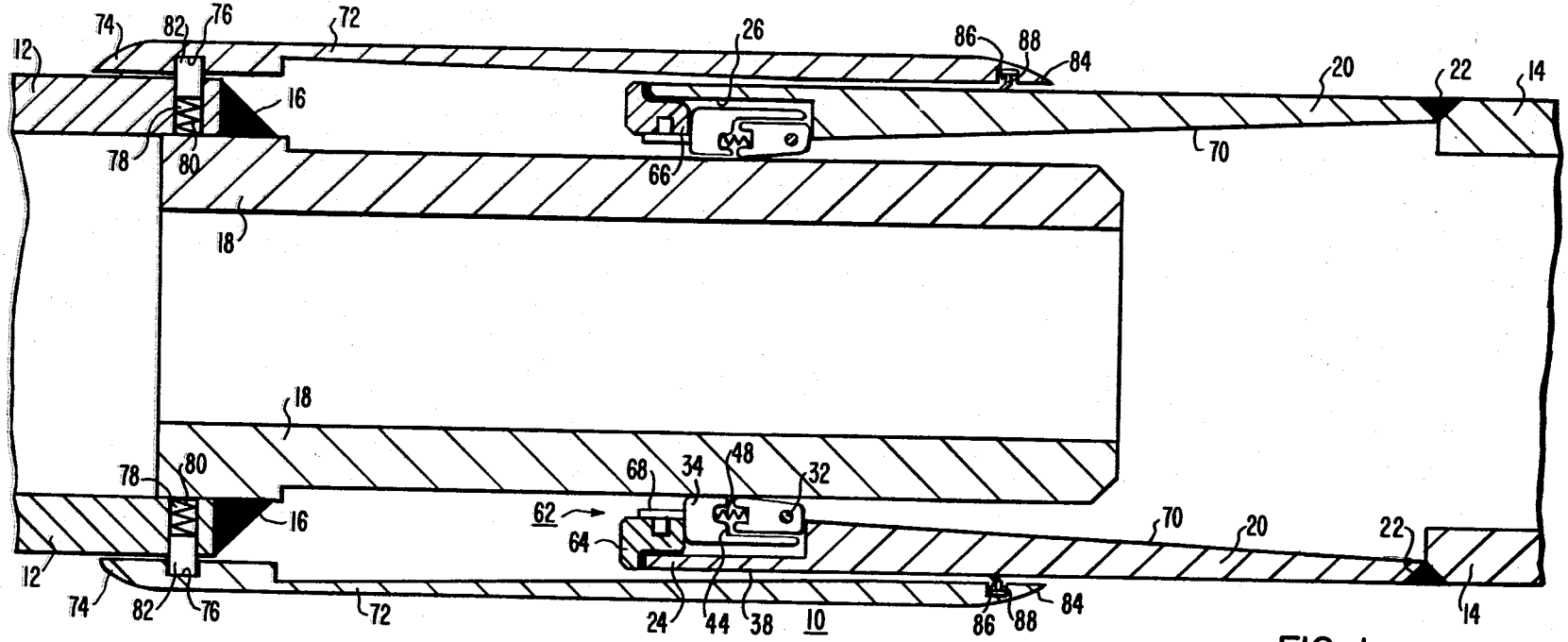
FIG. 1 is an elevational sectional view of a conductor sliding contact assembly according to the teachings of this invention.
Figure 2:
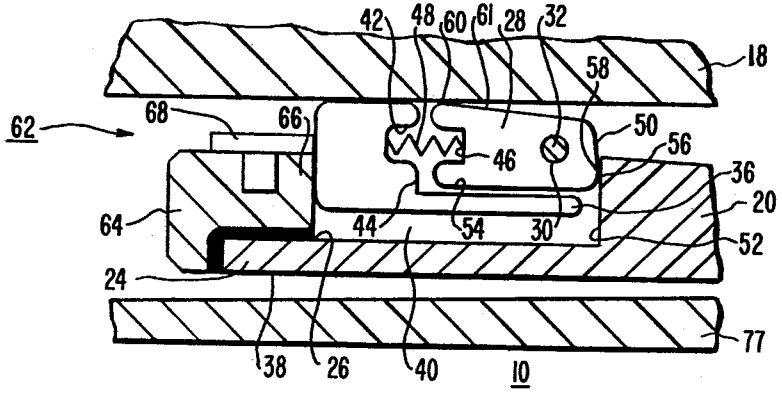
FIG. 2 is an enlarged view of the contact fingers.

As can be seen from FIGS. 1 and 2, the contact assembly 10 is utilized to electrically connect two electrical conductors 12 and 14. The conductors 12, 14 may, for example, be the inner conductors of a gas-insulated transmission line, the inner or outer conductors of an air-insulated transmission line, or may be stationary and movable contacts in high-current electrical switches. Physically secured to the one conductor 12, by means such as the weld 16, is a plug member 18. The plug member 18 is preferably of a smaller outside diameter than the outside diameter of the conductor 12. Physically secured to the other conductor 14, by means such as the weld 22, is a socket member 20. The socket member 20, of a hollow, generally cylindrical configuration, has an inner diameter which is greater than the outer diameter of the plug member 18, and the plug member 18 is received within the socket member 20. The electrical conductors 12, 14, the plug member 18 and the socket member 20 would be of a good electrically conducting material such as copper or aluminum.

The socket member 20 has, preferably at the axial end section 24 axially distant from the electrical conductor 14, an annular recess 26 therein. Disposed within the annular recess 26, in a generally ring-shaped configuration, are a plurality of individual contact fingers 28. Each of the contact fingers 28 has an aperture 30 therethrough through which extends a circular, metallic stabilizer ring 32. During construction of the assembly, the contact fingers 28 are strung upon the stabilizer ring 32 like beads upon a necklace. The ends of the stabilizer ring 32 are then crimpled to slightly enlarge them and prevent the contact fingers 28 from sliding off. In addition to aiding in the assembly of the device, the stabilizer ring 32, by maintaining the contact fingers 28 in close proximity to each other, provides lateral stability and prevents the fingers 28 from slipping out of place during operation of the contact assembly 10.

Also disposed within the recess 26 is a generally annular holder 34 which is axially spaced apart from the contact fingers 28. The holder 34 has an annular, axial projection 36 extending outwardly therefrom to a position axially adjacent to the contact fingers 28, and radially outwardly from the contact fingers 28. The holder projection 36 is spaced apart from the socket member 20, and more particularly that portion 38 of the socket member 20 which is radially outwardly from the recess 26. Being thus spaced apart, the socket member portion 38 and the holder projection 36 form an annular space 40 therebetween.

The holder 34 has a circumferential channel 42 formed in the radial surface 44 thereof, and each contact finger 28 has a recessed spring seat 46 therein. Disposed between the contact fingers 28 and the holder 34 are a plurality of individual helical coil springs 48, with each contact finger 28, and more particularly the spring seat 46 having a helical coil spring 48 disposed therein. Preferably, the diameter of each spring 48 is greater than the radial diameter of the spring seat 46, so that when the spring 48 is inserted from the side by an automated mechanical procedure (prior to stringing the fingers 28 on the ring 32), the spring 48 is compressed across its diameter and elongated in a direction perpendicular to the plane of the drawing. The spring 48 is thus securely retained by the spring seat 46 and will not fall out or come loose during either assembly or operation of the contact assembly 10. The other end of the coil spring 48, which is disposed within the channel 42 in the holder 34, is secured thereto by means such as a flexible adhesive.

Each of the contact fingers 28 (see FIG. 2) has an end surface 50 which is seated against a surface 52 of the socket member 20, and a bottom surface 54 which is disposed adjacent to the axial projection 36 of the holder 34. The end surface 50 and the bottom surface 54 intersect at an angle 56 which is less than 90°. The force of the spring 48 causes the contact finger 28 to bear against the socket member surface 52 at the point 58. As can be seen from the figure, the bearing point 58 is offset from the line of action of the spring 48. This causes the force from the spring 48 to be resolved into a component parallel to the direction of relative motion between the plug member 18 and the socket member 20, and a force component perpendicular to that direction. A contact pressure is thus maintained between the contact finger 28 and the socket member 20 at the point 58, and another contact pressure at the point 60 between a protruding surface 61 of the finger contact 28 and the plug member 18. By adjusting the offset distance between the spring-force line of action and the engagement point 58, the relative contact pressure can be adjusted in any manner desired. A more detailed description of the contact finger 28 may be found in the heretofore referenced patent application by Meyer, whose disclosure is incorporated hereinto by reference.

Physically contacting the holder 34, and loading the coil spring 48 so as to produce a force upon the contact fingers 28, are loading means 62. The loading means 62 comprise an annular retainer 64 which is secured to the end of the socket member 20 and a holding ring 66 which is disposed within the recess 22 intermediate the holder 34 and the retainer 64. A plurality of bearing members 68 are utilized to prevent excessive side loading of the plug member 18 on the contact fingers 28. Although any number of bearing members 68 may be utilized, it has been found that the contact assembly 10 works satisfactorily when there are three bearing members 68 disposed 120° apart about the holding ring 66.

As can be seen, the contact assembly 10 provides for axial misalignments of the two conductors 12, 14. The annular space 40 is provided so that any nonparallelism between the axis of the conductors 12, 14 can be taken up within this annular space. The misalignment of the plug member 18 within the socket member 20 will cause a radial movement of the ring of contact fingers 28 and the holder 34 in a direction to compensate for the misalignment, with the annular space 40 thereby being smaller on the side of the misalignment and larger at the opposite side. the radial force exerted against the holder 34 and the contact fingers 28 by the misalignment is sufficient to move the contact point 58 between the contact fingers 28 and the socket member 20 radially outwardly the necessary distance to compensate for misalignments substantially equal to the radial depth of the annular space 40.

As can be noted from the drawing, the socket member 20 has a tapered, generally increasing inner diameter section 70 from a point adjacent to the contact fingers 28 and extending axially toward the conductor 14 to which it is secured. This gradually increasing diameter provides for angular misalignment between the conductors 12 and 14. This tapered portion allows the plug 18 to enter the socket member 20 at an angle, which would not otherwise be possible without the tapered inner diameter 70.

Shielding the connection of the two conductors 12, 14 is an annular, hollow, electrically conducting shield sleeve 72. The shield sleeve 72 has, at one end 74 thereof, a plurality of spaced-apart cavities 76, which are aligned with corresponding cavities 78 in the conductor 12. Disposed within the conductor cavity 78 is a helical shield spring 80, which acts upon the conductor 12, or the extension of the plug 18, and also upon a shield contact button 82 which extends into the shield cavity 76. As the plurality of contacts 82 are spaced around the periphery of the annular shield 72, these members function to physically retain the shield sleeve 72 in its position around, and connected to, the conductor 12.

The other end 84 of the shield sleeve 72 has an annular groove 86, therein and disposed within this groove 86 is a wiper seal 88. The wiper seal 88 maintains the shield sleeve 72 in its location surrounding the socket member 20 while permitting sliding, axial movement of the socket member 20 relative to the shield sleeve 72. Being thus connected, the shield sleeve 72 will maintain its position connected to the conductor 12 and the socket member 20 while compensating for the relative movement of the socket 20 with respect to the plug member 18 and conductor 12.

Thus, it can be seen that this invention provides a high-current contact assembly for electrically connecting two electrical conductors while allowing relative movement therebetween.

I claim as my invention:

1. A contact assembly for electrically connecting first and second electrical conductors comprising:

a cylindrical plug member fixedly secured to said first conductor and having an outer diameter;

a cylindrical, hollow socket member fixedly secured to said second conductor and having an inner diameter greater than said plug member outer diameter, said socket member receiving said plug member therein, said socket member having an annular recess therein;

a plurality of contact fingers disposed within said recess and seated against a radial surface of said socket member;

an annular holder disposed within said recess axially spaced from said contact fingers, said holder having an annular axial projection therefrom extending axially adjacent said contact fingers radially outwardly therefrom, said holder projection being radially spaced apart from said socket member, said holder projection and said socket member forming an annular space therebetween;

resilient biasing means disposed intermediate said contact fingers and said holder and acting upon each of said contact fingers; and means connected to said socket member and physically contacting said holder for loading said biasing means so as to produce a force upon said contact fingers, said force having a component in the radial direction and a larger component in the axial direction, said radial component producing contact pressure between each of said fingers and said plug member and said axial component producing contact pressure between said fingers and said socket member surface.

2. The contact assembly according to claim 1 wherein each of said contact fingers has an aperture therein centered on an axis perpendicular to both of said spring force components, and a stabilizer ring extends through all of said apertures.

3. The apparatus according to claim 1 wherein each of said contact fingers has a recessed spring seat therein, said holder has a grooved channel formed in a radial surface thereof, and said biasing means comprises a plurality of helical springs each fixedly secured at one end thereof to said spring seat and having the other end thereof disposed within said channel.

4. The contact assembly according to claim 1 including an annular, hollow shield of conductive material extending from said first conductor to said socket member, and retaining means for holding said shield in place connected to said first conductor and said socket member.

5. The contact assembly according to claim 1 wherein said socket member has a gradually increasing inner diameter from a point adjacent said contact fingers and extending axially toward said second conductor.

6. The contact assembly according to claim 1 wherein said loading means comprises a retainer secured to said socket member and a holding ring disposed within said recess intermediate said retainer and said holder and physically contacting said holder.

7. The contact assembly according to claim 6 including a bearing member disposed intermediate said holding ring and said retainer adjacent said plug member, said bearing member limiting said contact pressure between said plug member and said contact fingers.

* * * * *